US010578126B2

(12) United States Patent
Cermak

(10) Patent No.: US 10,578,126 B2
(45) Date of Patent: Mar. 3, 2020

(54) LOW SOUND TUBEAXIAL FAN

(71) Applicant: ACME ENGINEERING AND MANUFACTURING CORP., Muskogee, OK (US)

(72) Inventor: Jan Cermak, Tulsa, OK (US)

(73) Assignee: ACME ENGINEERING AND MANUFACTURING CORP., Muskogee, OK (US)

( * ) Notice: Subject to any disclaimer, the term of this patent is extended or adjusted under 35 U.S.C. 154(b) by 174 days.

(21) Appl. No.: 15/489,844

(22) Filed: Apr. 18, 2017

(65) Prior Publication Data

US 2017/0306978 A1 Oct. 26, 2017

Related U.S. Application Data

(60) Provisional application No. 62/327,591, filed on Apr. 26, 2016.

(51) Int. Cl.

| | |
|---|---|
| ***F04D 29/54*** | (2006.01) |
| ***F04D 19/00*** | (2006.01) |
| ***F04D 29/32*** | (2006.01) |

(52) U.S. Cl.

CPC ..... *F04D 29/542* (2013.01); *F04D 19/002* (2013.01); *F05D 2240/121* (2013.01); *F05D 2250/184* (2013.01)

(58) Field of Classification Search

CPC ..... F05D 2240/121; F05D 2250/184; F04D 19/002; F04D 29/325; F04D 29/526; F04D 29/542

(Continued)

(56) References Cited

U.S. PATENT DOCUMENTS 1,062,258 A * 5/1913 Sohlotter ..... F01D 9/041 415/119
2,191,341 A 2/1940 Curley (Continued)

FOREIGN PATENT DOCUMENTS

| | | | |
|---|---|---|---|
| DE | 102006058415 A1 * 6/2008 | ..... | F01D 5/141 |
| EP | 0 708 249 4/1996 | | |
| FR | 2386706 A1 * 11/1978 | ..... | F04D 29/526 |

OTHER PUBLICATIONS

Thomson Innovation English Abstract for EP 708249, published Apr. 24, 1996.

(Continued)

*Primary Examiner* — John M Zaleskas
(74) *Attorney, Agent, or Firm* — Staas & Halsey LLP

(57) ABSTRACT

A tubeaxial fan housing has a planar support vane that is fixed at sides thereof to opposing interior sides of the tubular housing, toward an inlet of the housing. The support vane receives a shaft on an underside thereof, upon which a propeller is mounted near an outlet end of the housing. The support vane has a curved edge facing the propeller to change a pattern of eddies generated downstream of the support plate and thereby reduce the noise generated by the fan. The curve is an S-shape and may be a sine wave whose period is ⅕ the propeller diameter. The propeller is positioned a relatively large distance from the curved edge of the support vane to reduce further the generation of eddies. That is, the closest point of the curved edge to the propeller is one chord length, which chord is at a tip of a propeller blade. A rounded inlet bell on the housing includes a rounded surface to reduce further turbulence across the propeller and support vane to further reduce sound. The propeller has only five blades to further reduce the generation of eddies.

23 Claims, 10 Drawing Sheets

(58) Field of Classification Search
USPC ..... 415/119, 208.1, 208.2
See application file for complete search history.

(56) References Cited

U.S. PATENT DOCUMENTS 2,790,596 A 8/1953 Stirling
2,698,128 A * 12/1954 Ault ..... F04D 29/526 415/210.1
2,708,373 A 5/1955 Werner
2,855,141 A * 10/1958 Van Rijn ..... F04D 25/0613 415/208.2
3,584,968 A * 6/1971 Keith ..... F04D 17/165 415/208.2
3,650,633 A * 3/1972 Benoit ..... F04D 17/025 415/143
3,883,264 A * 5/1975 Rao ..... F01D 1/04 415/119
3,924,964 A 12/1975 Lievens et al.
3,969,805 A 7/1976 Lievens et al.
3,976,393 A * 8/1976 Larson ..... F04D 29/646 415/119
3,995,970 A * 12/1976 Nobuyuki ..... F04D 29/668 415/119
4,008,007 A 2/1977 Shipes
4,087,927 A 5/1978 Basmajian
4,088,017 A 5/1978 Olges
4,089,618 A * 5/1978 Patel ..... F04D 29/668 416/228
4,173,300 A 11/1979 Sanko
4,318,669 A * 3/1982 Wennerstrom ..... F01D 9/02 415/119
4,352,635 A 10/1982 Saunders
4,475,867 A 10/1984 Smith
4,482,302 A 11/1984 Grignon
4,692,091 A 9/1987 Ritenour
4,884,314 A * 12/1989 Miner ..... A47L 5/14 15/344
4,927,324 A * 5/1990 Coup ..... F04D 25/08 415/121.2
5,184,938 A 2/1993 Harmsen
5,273,400 A 11/1993 Amr
5,279,379 A 1/1994 Sixsmith
5,513,951 A 5/1996 Komoda et al.
5,551,838 A 9/1996 Hugbart
5,769,607 A 6/1998 Neely et al.
5,816,781 A * 10/1998 Bercot ..... F04D 19/002 417/371
6,142,733 A 11/2000 Alizadeh et al.
6,241,474 B1 6/2001 Alizadeh et al.
6,315,521 B1 11/2001 Hunt
6,368,061 B1 4/2002 Capdevila
6,428,277 B1 8/2002 Holmes
6,471,473 B1 * 10/2002 Wilkinson ..... F04D 19/002 415/182.1
6,702,548 B1 3/2004 Lievens et al.
6,908,287 B2 * 6/2005 Cho ..... F04D 29/326 415/119
7,331,759 B1 2/2008 Tejeda
8,540,496 B2 * 9/2013 Suzuki ..... F04D 29/542 417/423.14
8,932,013 B2 1/2015 Khalitov et al.
2002/0131863 A1 * 9/2002 Cheng ..... F04D 19/002 415/219.1
2002/0159883 A1 * 10/2002 Simon ..... F04D 29/703 415/193
2007/0297912 A1 * 12/2007 Reuter ..... F04D 13/06 416/93 R
2007/0297913 A1 * 12/2007 Reuter ..... F04D 29/601 416/93 R
2009/0226309 A1 9/2009 Reuter
2009/0263238 A1 10/2009 Jarrah
2012/0039731 A1 * 2/2012 Sadi ..... F04D 29/164 417/423.7
2012/0210572 A1 * 8/2012 Kampf ..... F04D 25/08 29/700
2013/0309110 A1 11/2013 Reuter
2014/0072435 A1 * 3/2014 Choi ..... F04D 19/002 416/204 R
2014/0119892 A1 * 5/2014 Mornan ..... F04D 29/542 415/122.1
2014/0237819 A1 * 8/2014 Brownell ..... F04D 29/281 29/889.6
2014/0241868 A1 * 8/2014 Brownell ..... F04D 29/023 415/191
2014/0241894 A1 * 8/2014 Brownell ..... F04D 19/002 416/223 R
2014/0241920 A1 * 8/2014 Brownell ..... F04D 29/023 417/423.1
2015/0023779 A1 * 1/2015 Li ..... F04D 19/002 415/119
2015/0023791 A1 * 1/2015 Sadi ..... F04D 29/666 415/213.1
2015/0217851 A1 * 8/2015 Kelso ..... B64C 3/16 244/200
2015/0300371 A1 10/2015 Mehlhorn
2015/0330411 A1 * 11/2015 Heli ..... F04D 29/542 415/208.2
2016/0003095 A1 * 1/2016 Romano ..... F01D 5/145 415/1
2016/0238033 A1 * 8/2016 Fang ..... F04D 29/325

OTHER PUBLICATIONS

Conventional Belt Drive Tubeaxial Fan, Model 1 HA, ACME Engineering and Manufacturing Corp. brochure, pp. 52-54, prior to 2015.
ACME Engineering and Manufacturing Corp. brochure for Model HQ, Jul. 2015, 2 pages.
Declaration of Lee Buddrus, President of the Assignee, ACME Engineering and Manufacturing Corporation, dated Aug. 28, 2019, six pages.

* cited by examiner

LOW SOUND TUBEAXIAL FAN

CROSS REFERENCE TO RELATED APPLICATION

This application claims the benefit under 35 U.S.C. Section 119 of U.S. Patent Application Ser. No. 62/327,591, filed Apr. 26, 2016, entitled "Low Sound Tubeaxial Fan", which is hereby incorporated by reference in its entirety into this application.

BACKGROUND OF THE INVENTION

1. Field of the Invention

This invention relates to air moving equipment and, more particularly, to tubeaxial fans.

2. Description of the Related Art

FIGS. 1-3 herein show a conventional tubeaxial fan which can be used in, e.g., inline ducts in commercial buildings, in paint spray booths, at golf courses for cooling and drying greens, or in any other application requiring a directed jet of air.

Such a tubeaxial fan 10 usually includes a tubular housing 20 with a motor mount 30 located on a top 22 of the housing 20 that receives a motor (not shown). Such fans are usually available in, e.g., 16-48 inch diameter sizes.

An inlet 50 and an outlet 54 to the fan 10 are generally perpendicular to a central longitudinal axis "X" of the housing 20, along which an airstream "Y" moves within the housing 20. The housing 20 may include a gasketed access door (not shown) for easier inspection of the housing 20 interior and maintenance.

A planar, rectangular support plate or vane 60 is fixed at short ends 62, 64 thereof to opposing interior sides 24, 26 of the tubular housing 20, about midway thereof. This conventional support vane 60 has a continuous, straight upstream edge 66 adjacent a propeller, as described below.

The support vane 60 receives a shaft 70 and a bearing assembly 72 on an underside 68 thereof. A propeller 80 is attached to the shaft 70. The propeller 80 usually includes six blades 81.

As noted above, the support vane 60 continuous straight edge 66 closely faces the propeller 80. The distance between the propeller 80 and the straight edge 66 in this conventional fan is relatively small, i.e., about 1.13 inches.

A streamlined belt enclosure 90 extends from a top interior portion 28 of the tubular housing 20 to an upper side 61 of the support vane 60. A belt (not shown) extends from the motor, through the streamlined enclosure 90, and to the shaft 70 to turn the propeller 80. The motor mount 30, the motor, the shaft 70, and the belt are located outside of the airstream "Y".

Thus, such a coaxial fan usually includes a support vane 60 that has a continuous straight edge 66 facing a six bladed propeller. The propeller is located a first, relatively close distance from the straight edge 66 of the support vane 60.

It is known that such conventional tubeaxial fans produce noise levels that can be harmful to workers near the fan, such as about 40 sones. With an ever-increasing awareness of workplace safety a quieter tubeaxial fan is needed.

Efforts have been made to reduce the noise of such fans. For example, in U.S. Pat. No. 6,702,548 of Lievens et al., the six blades thereof are shaped according to particular parameters, including chord length, and a bottom wall of the bearing assembly (which bottom wall is parallel to the shaft) is spaced from the shaft a distance that is dictated by the blade design. This patent describes that the bearing assembly preferably should not be connected to the interior walls of the housing, and does not use a support vane separate from the bearing assembly. However, the patent describes the optional use of straight-edged support plates that are fixed at ends thereof to the top plate of the bearing assembly and at the other ends thereof to the inner circumferential surface of the fan housing. More particularly, as shown in FIG. 4 herein, the patent describes:

> Each of the support plates 212*a* and 212*b* present a substantially equivalent plate width $W_P$ extending along the interior circumferential surface 218 of the cylinder 212 and being generally parallel with the rotational axis of the propeller 214. The plate width $W_P$ preferably is minimized as much as possible but still provides sufficient support . . . the plate width should be at least one-tenth of the axial length to provide the desired support function . . . . In addition to minimizing the width of the support plates, it is further believed that positioning the plates as far upstream from the propeller as possible facilitates minimizing any obstruction of airflow provided by the plates.

While the structure described in this patent appears to help reduce tubeaxial fan noise, the present inventor has found that other structure, which does not require significant alteration of the conventional tubeaxial fan, and which does not significantly increase production costs, can reduce the noise generated by such fans.

SUMMARY OF THE INVENTION

It is a purpose of the present invention to provide a tubeaxial fan that operates at a lower noise level than conventional tubeaxial fans.

It is another purpose to provide a lower-noise tubeaxial fan that is the same size(s) as and can easily replace conventional tubeaxial fans.

It is another purpose to provide a lower noise tubeaxial fan that can be used in new construction or as a replacement fan.

It is still another purpose to provide a tubeaxial fan that operates at lower sound levels so that people who are in the vicinity of the fan are exposed to safer sound levels.

It is further a purpose to provide a significantly quieter tubeaxial fan whose cost is competitive with conventional tubeaxial fans.

Finally, it is a purpose to provide a tubeaxial fan that can be used anywhere a conventional tubeaxial fan would be used, especially where less noise is desired, thereby improving workplace safety.

In contrast to the above-described tubeaxial fans, the inventor herein has found that the noise created by a conventional tubeaxial fan can be reduced by changing the shapes, juxtaposition and number of components of the conventional tubeaxial fan.

To achieve the foregoing and other purposes of the present invention there is provided a tubeaxial fan having a curved edge on the support vane facing the propeller instead of the conventional entirely straight edge. In one embodiment, the support vane edge has a linear central area flanked by two curved areas, referred to as "S" shapes. The "S-shaped" support vane reduces the fan's sound by changing the pattern of generation of eddies downstream. The propeller is also positioned a relatively large distance from the curved areas of the support vane to reduce further the generation of eddies. The closest point of the curved edge 180 to the fan propeller is one chord length of the fan's propeller, which chord is at the tip of the propeller. An inlet bell includes a rounded inlet surface to reduce turbulence going across the propeller and vane section to further reduce sound. Finally, in the preferred embodiment, the number of blades is five instead of the conventional six, which further reduces the generation of sound downstream of the trailing edges of the blades.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Figure 1:
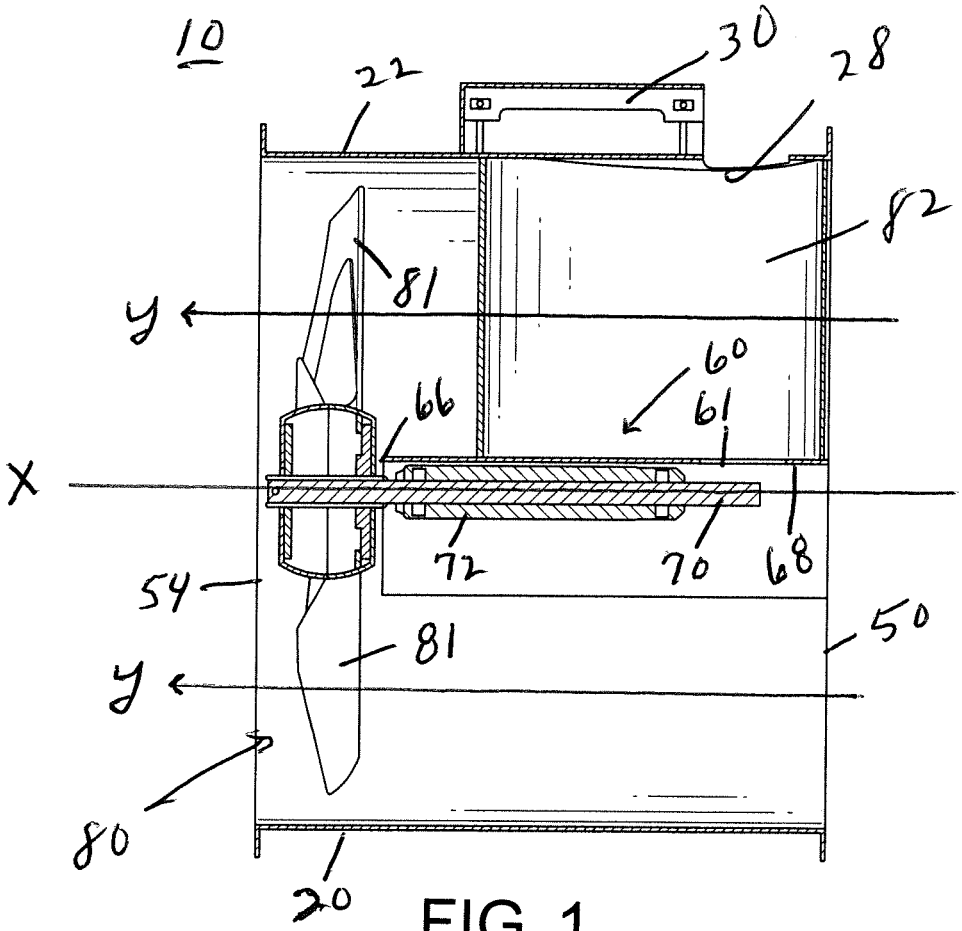
FIG. 1 PRIOR ART
FIG. 1 is a side, cross-sectional view of a conventional tubeaxial fan.

As shown particularly in FIG. 5-9 herein, a tubeaxial fan 100 according to the present invention includes a housing 110 with a first, open, upstream end 112, and a second, open downstream end 114.

The housing 110 is preferably made of heavy gauge steel for structural rigidity and long service life. The ends 112 and 114 of the housing 110 should include integral rolled flanges 117, 119 for structural rigidity and to connect to a mounting surface, for example duct work, without air leakage. The open ends 112 and 114 allow air to be drawn by a propeller (discussed below) to pass through the housing 110 from the upstream end 112 to the downstream end 114.

Preferably the housing 110 is cylindrically shaped. However, as would be understood by one of ordinary skill, the housing 110 can be shapes other than cylindrical and still take advantage of the benefits of the invention described herein.

Figure 12:
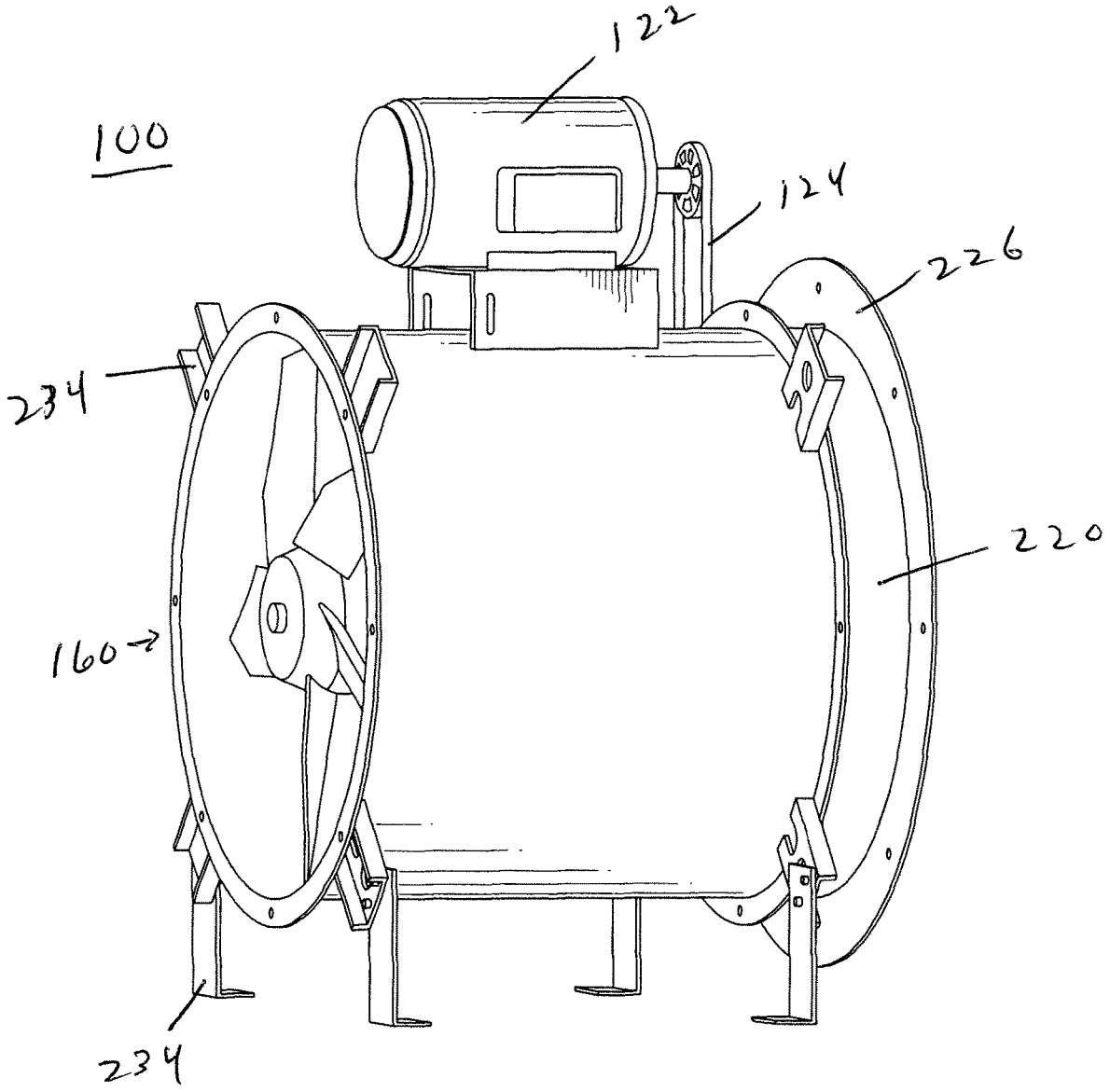
FIG. 12 is a perspective view of the inlet bell attached to the fan according to the present invention.

A motor mount 120 located on a top exterior portion 115 of the housing 110 supports a motor 122 (see FIG. 12). Both the motor 122 and the motor mount 120 are located outside of the housing 110, and outside of an airstream "Y'" generated by the propeller described below.

A planar support plate or vane 130 is fixed at first and second sides 132 and 134 thereof to opposing interior sides 111 and 113, respectively, of the housing 110. In contrast to the location of the conventional support vane 60 discussed above, the support vane 130 of the present invention is fixed more toward the first upstream end 112 of the housing 110. That is, preferably, the sides 132, 134 of the vane 130 are attached more toward the end 112 of the housing 110, than the middle, but still preferably spaced from the inlet 112.

As with the conventional fan 10 described above, the support vane 130 of the present invention receives a shaft 140 and a bearing assembly 150 on an underside 136 thereof. The shaft 140 receives at a first end 142 a propeller 160 which is located at the second, downstream end 114 of the housing 110.

A belt enclosure 170 extends from a top interior portion 118 of the tubular housing 110 to an upper side 138 of the support vane 130. A belt 124 (FIG. 12) extends from the motor 122, through the enclosure 170, and to the shaft 140 to turn the propeller 160. The belt enclosure 170, as with the prior art, is preferably streamlined to facilitate movement of air in the housing 110.

In addition to the motor 122 and the motor mount 120, the belt 124, shaft 140, and bearing assembly 150 for the shaft 140 are located outside of the airstream "Y" which moves along a central longitudinal axis "X'" from the first, upstream end 112 of the tubular housing 110, through the tubular housing 110 (including the streamlined enclosure 170), past the propeller 160, which draws the air into the upstream end 112 of the fan 100, and out the second, downstream end 114.

The present inventor has found that re-configuring the edge of the support vane 130 across which the airstream "Y" moves downstream, reduces eddies, as described below particularly with regard to FIG. 8.

Figure 8:
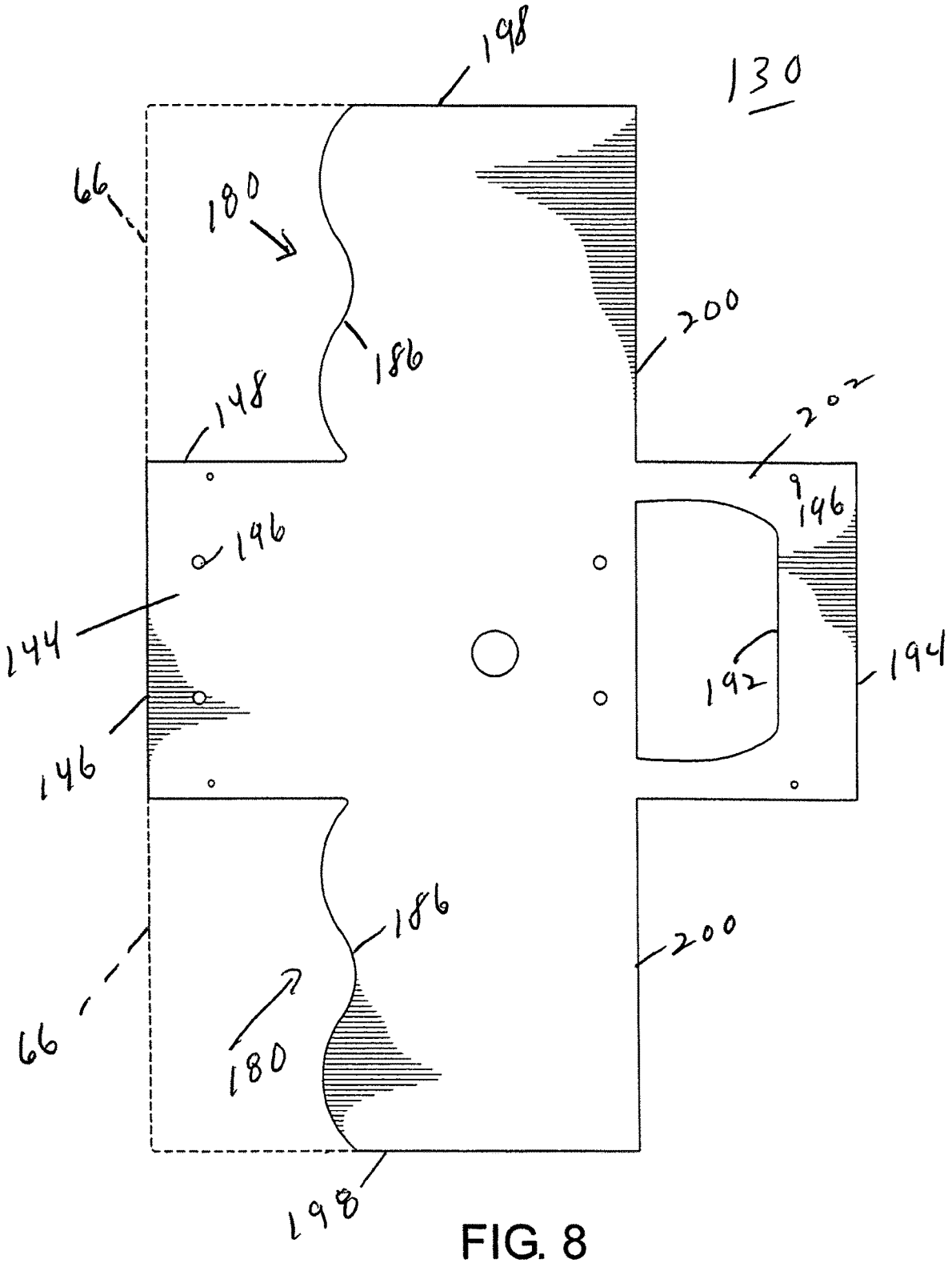
FIG. 8 is a plan view of the support vane of the fan shown in FIG. 5.

For ease of comparison, FIG. 8 includes, in broken lines, the conventional edge 66 of the support vane 60 described above, in addition to the curved edge (solid lines) 180 of the support vane 130 according to the present invention. The edge 180 of the support vane 130 that faces the propeller 160 includes at least one curve (solid lines) 186.

Figure 2:
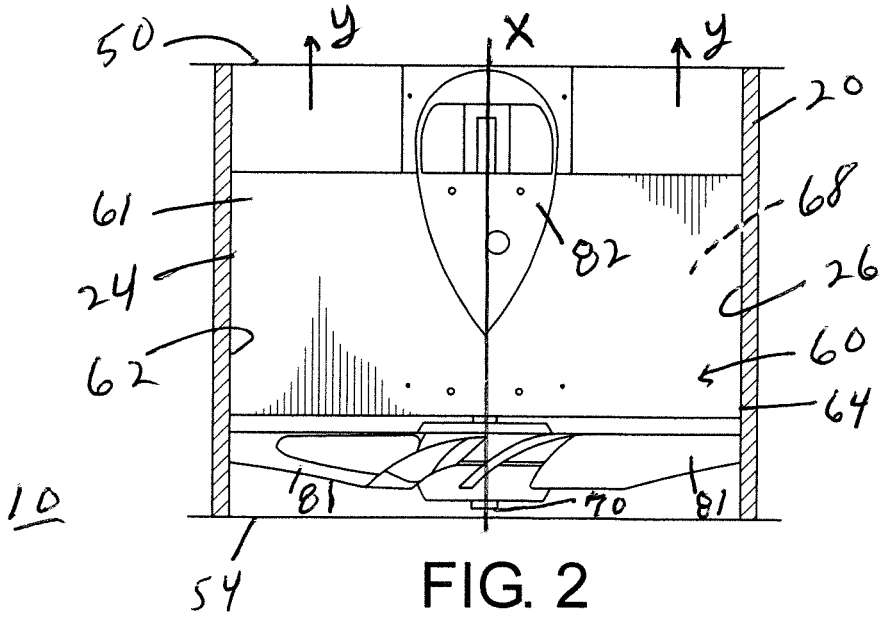
FIG. 2 PRIOR ART
FIG. 2 is a top view of the conventional tubeaxial fan shown in FIG. 1 with the top of the housing cut away to show the propeller, support vane and streamlined enclosure.
Figure 3:
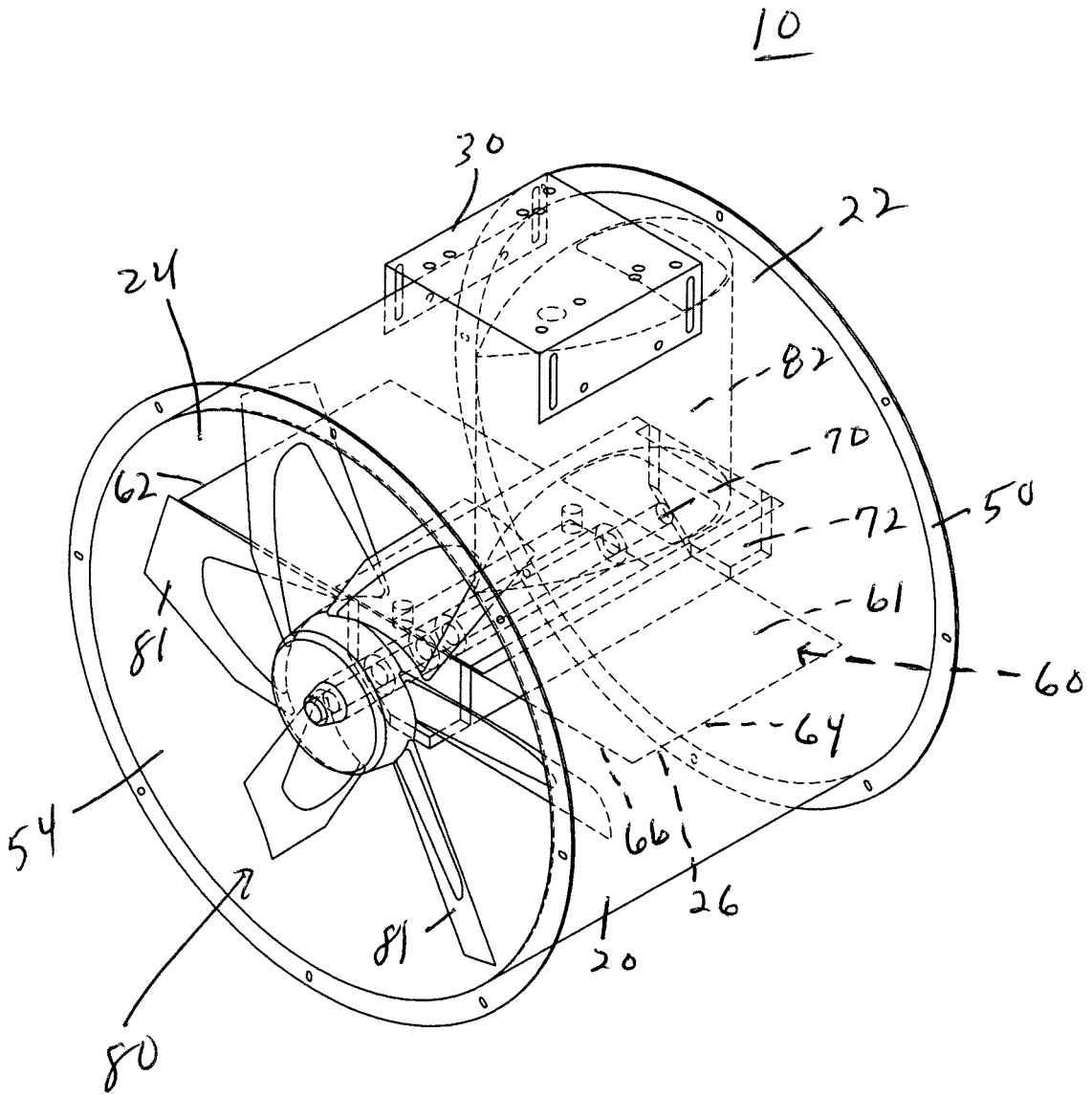
FIG. 3 PRIOR ART
FIG. 3 is a perspective view of the conventional tubeaxial fan shown in FIG. 1, using dashed lines to represent components interior to the tubular fan housing.
Figure 4:
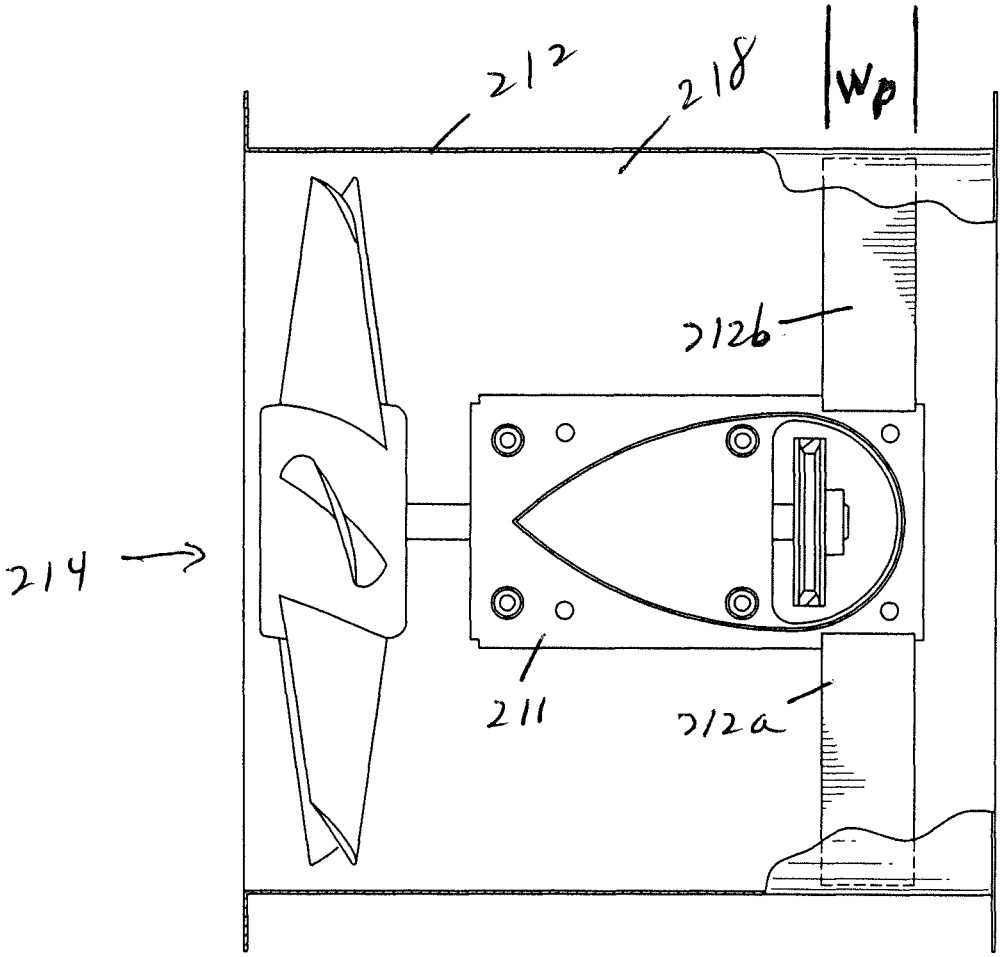
FIG. 4 PRIOR ART
FIG. 4 is a plan view of another conventional tubeaxial fan shown and described in U.S. Pat. No. 6,702,548.

More particularly, the support vane 130 includes a first downstream, substantially rectangular portion 144 that has a straight edge 146 that extends the substantial width of a circular hub 164 of the propeller 160 and faces a rear 166 of the hub 164. This edge 146 is located about the same distance from the propeller as the conventional edge 66 shown, e.g., in FIG. 2.

Extending from the straight edge 146 are perpendicular sides 148 extending to the curved edge 180 of the support vane 130. In the preferred embodiment, the curved edge 180 includes two curved, separated edges 186, referred to herein as "S" or wave shapes.

The shape of the "S" or wave is sinusoidal and the period of the sine wave is set at a length of about ⅕ of the fan's propeller diameter. An exemplary propeller 160 diameter is 34 inches, so the length is about 6.8 inches. Other usual diameters are 18", 24", 30", 42", etc.

The "S-shaped" support vane 130 reduces the fan's 100 sound by changing the pattern of eddies generated downstream from the support vane 130.

From the curved edges 186 extend sides 198 of the support vane 130 that are straight and perpendicular to the straight edge 146 of the first, rectangular portion 144. These straight sides 198 are fixed to the interior sides 111, 113, respectively, of the cylindrical housing 110 by, e.g., welding. Further, straight edges 200 extend perpendicularly inward from the sides 198.

In between the straight edges 200, about midway thereof, there is a rectangular extension 202. The extension 202 includes an opening 192 near an upstream end 194 of the support vane 130 through which the belt (not shown) passes, as with the conventional tubeaxial fan 10 described above.

Otherwise, the support vane 130 includes screw holes 196 for connecting the bearing assembly 150 and the enclosure 170.

As shown particularly in FIGS. 5-7A, the fan 100 includes a propeller 160 with a plurality of blades 162 emanating from the hub 164 mounted on the shaft 140. The hub 164 preferably presents a solid surface between the bases of the blades 162 fixed to the hub 164 so as to prevent the flow of air through the hub 164. Note that the rectangular portions 144 and 202 of the vane 130 are axially aligned with the solid hub 164.

The propeller 160 is preferably aluminum with die-formed circular arc airfoil blades 162 attached to the hub 164, which is also preferably die-formed.

As noted above, the conventional tubeaxial fan 10 propeller 80 includes six blades. According to an embodiment of the present invention shown in FIG. 7, the number of blades 162 is 5. This reduced number of blades, coupled at least with the above-described S-shape of the support vane 130, further reduces the generation of eddies off of the support vane 130.

Compared to the propeller 80 of the conventional tubeaxial fan 10 described above, which is very close to the edge 66 of the support vane 60, the present invention's propeller 160 is spaced a significant amount from the curved edge 180.

Figure 5:
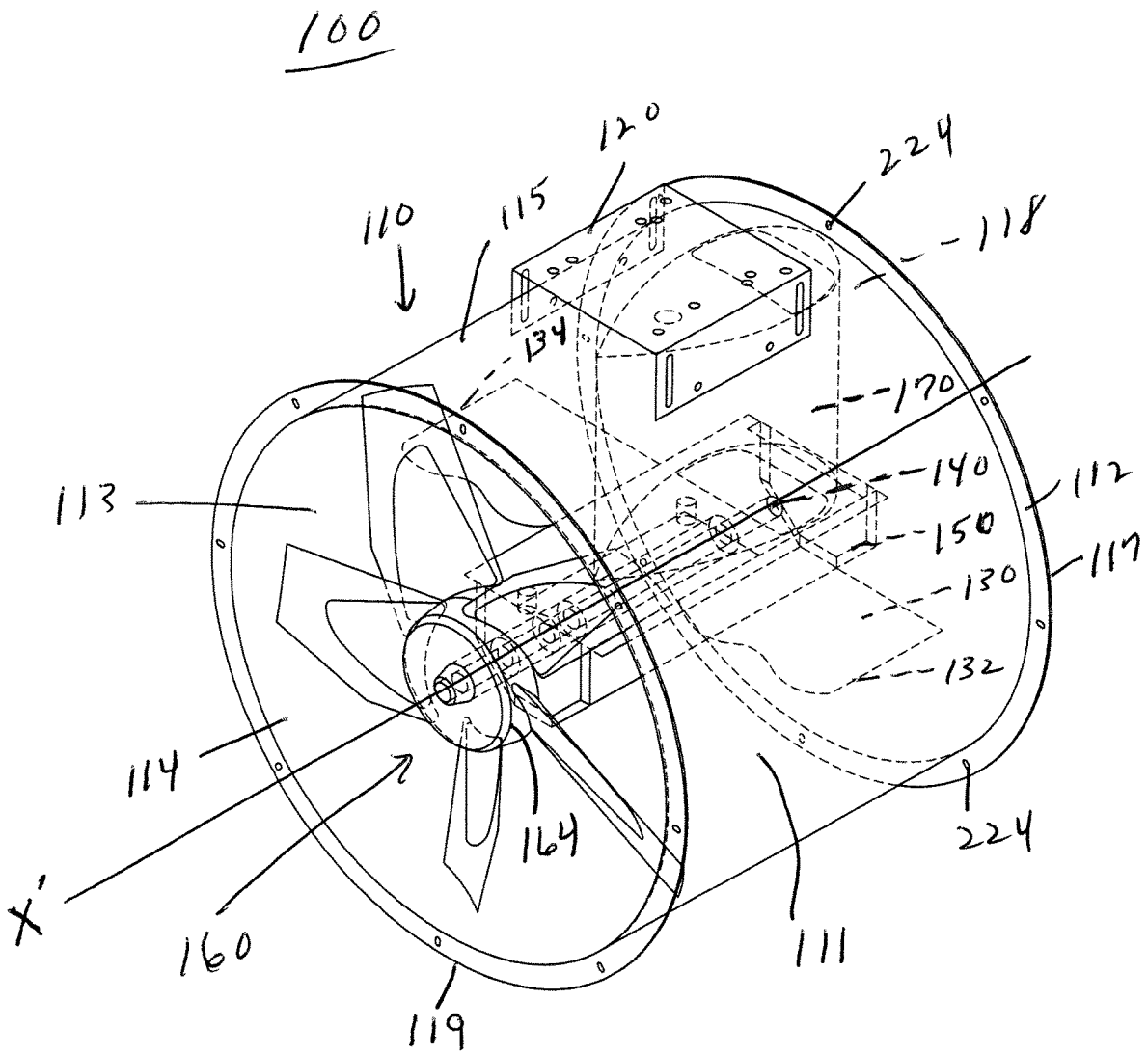
FIG. 5 is a perspective view of the tubeaxial fan of one embodiment of the present invention, using dashed lines to represent components interior to the fan housing.
Figure 6:
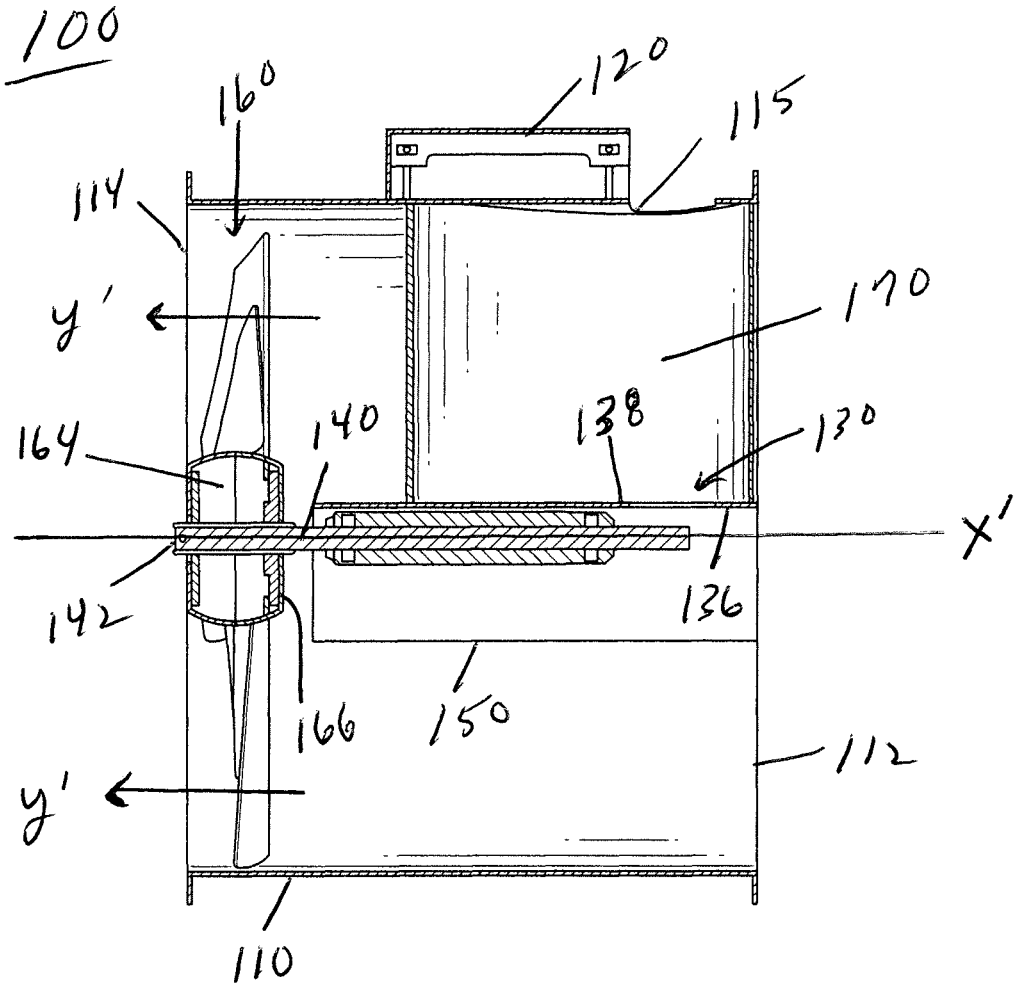
FIG. 6 is a view of the fan taken along line A-A of FIG. 7A.
Figure 7A:
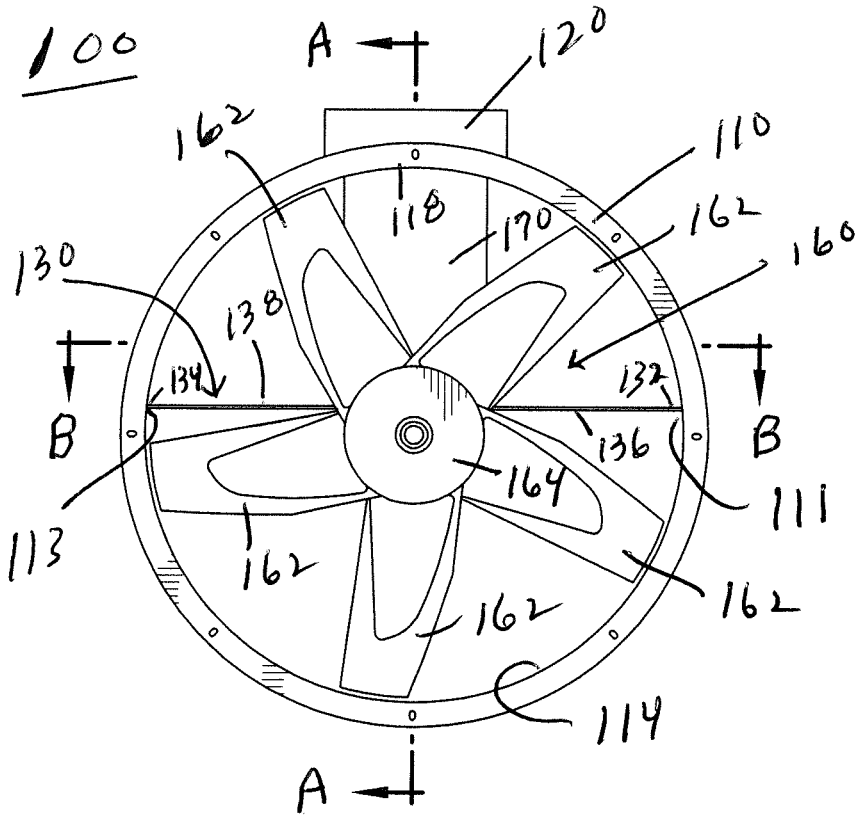
FIG. 7A is a rear view of the fan shown in FIG. 5.
Figure 7B:
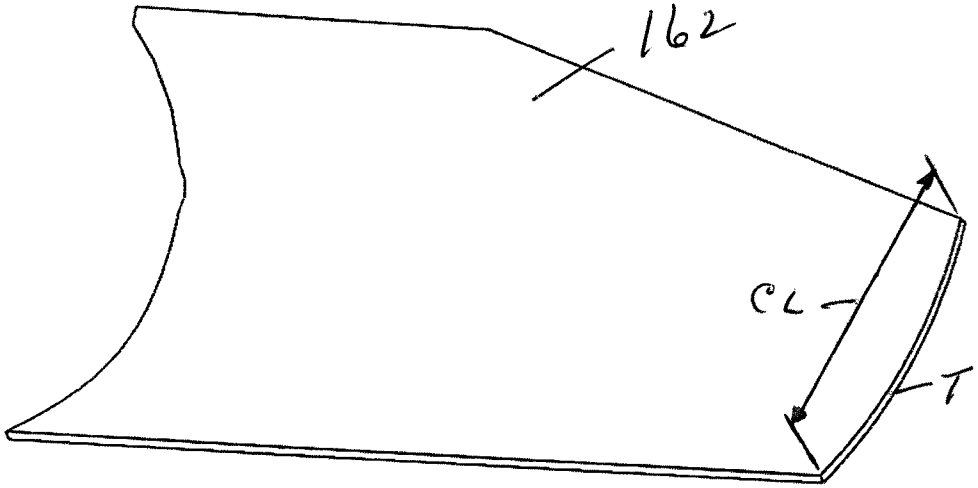
FIG. 7B is an enlarged view of a tip of a blade of the propeller shown in FIG. 7A.
Figure 9:
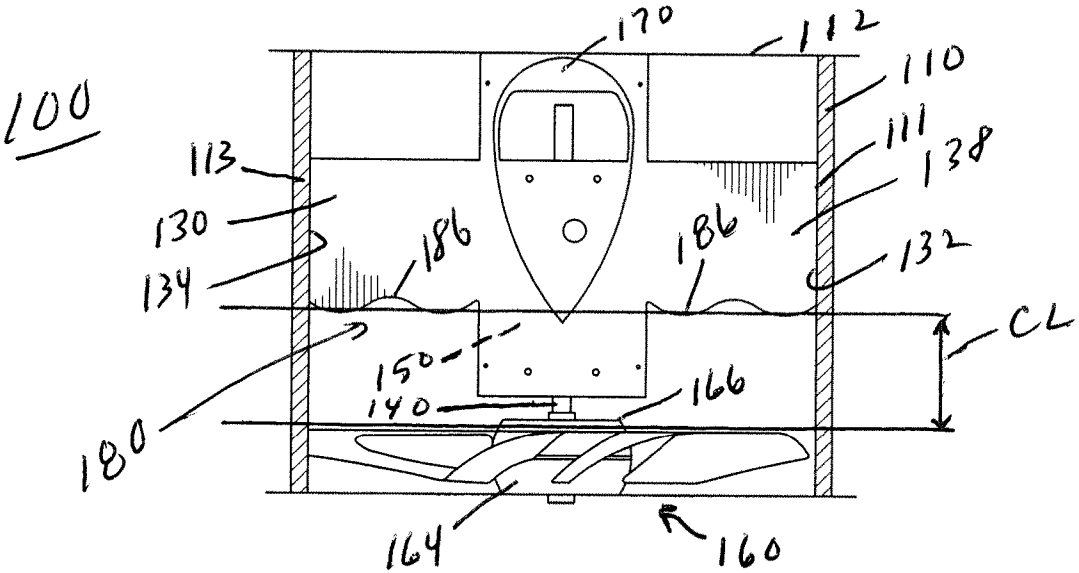
FIG. 9 is a view of the fan taken along line B-B of FIG. 7A.

In the embodiment shown particularly in FIGS. 5, 7A and 9, the curved edges 186 of the support vane 130 are moved back an amount which is based upon the propeller. That is, the closest point 188 of the "S-shaped" vane 130 to the propeller 160 is one chord length of a blade 162 of the fan's propeller 160. As shown in FIG. 7B herein, the chord length "CL" is defined as the length of the chord at the tip "T" of a blade 162 of the propeller 160.

As one example, the propeller 160 is positioned about eight inches, and more specifically 7.76 inches, from the curved edges 186 of the support vane 130. Note again the conventional distance of about 1.13 inches.

The distancing of the edge 180 of the support vane 130 from the propeller 160 further helps to reduce the generation of eddies.

According to the present invention, the support vane 130 has a primary function to keep the fan shaft 140 centered in the cylindrical housing 110. Nevertheless, the present inventor has found that the steps of moving the support vane 130 away from the propeller 160 and providing a curved edge on the support vane 130 reduces the sound generated by the fan relative to the sound generated by a conventional tubeaxial fan. Further, the inventor has found that using only one of these steps, i.e., moving the support vane edge away from the propeller or changing the shape of the support vane edge 180, as described herein, still reduces sound relative to the conventional tubeaxial fan.

Figure 10:
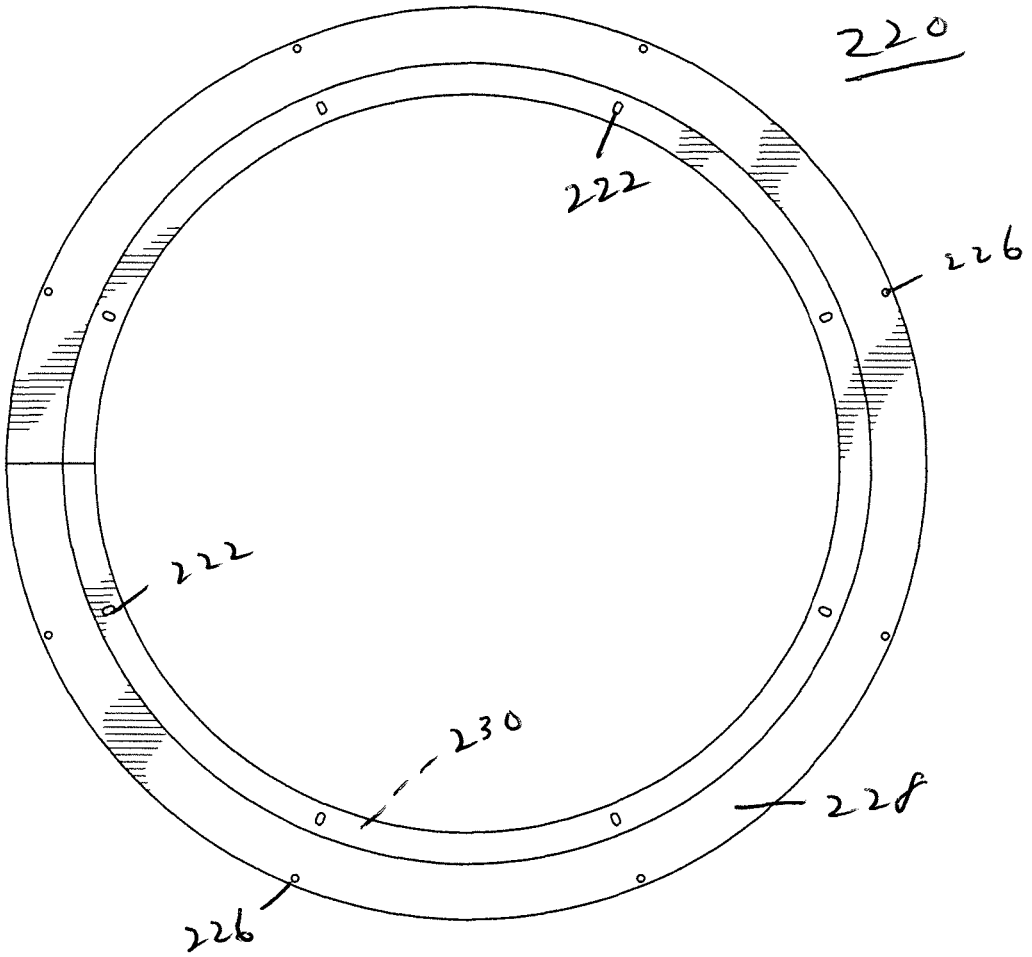
FIG. 10 is a plan view of an inlet bell according to an embodiment of the present invention.
Figure 11:
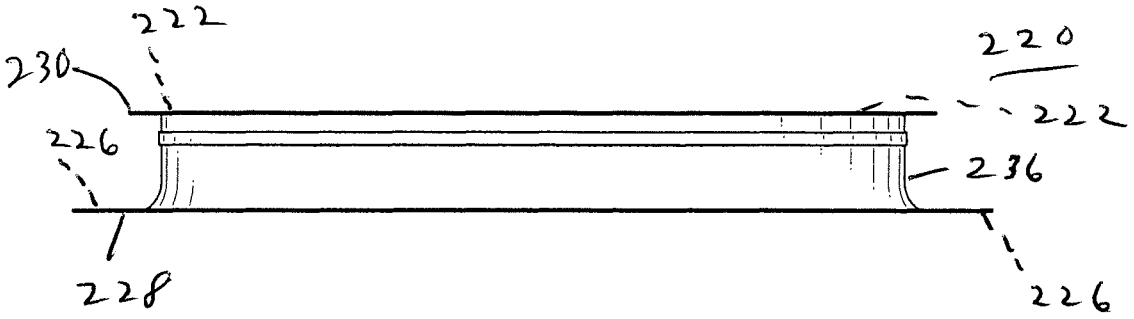
FIG. 11 is a side view of the inlet bell shown in FIG. 10.

As shown in FIGS. 10-12, the invention may include an inlet bell 220 that is attached to the flange 117 at the first, upstream end 112 of the housing 110. For this purpose, a plurality of holes 222 is provided that corresponds to holes 224 formed on the flange 117. Also, the inlet bell 220 may include radially outer holes 226 to connect the inlet bell 220 to an inline duct (not shown).

The inlet bell 220 is a circular member having a first, outer flange 228 in which the holes 226 are formed. Opposing the first, outer flange 228 is a second, inner flange 230 in which the holes 222 are formed and which is attached to the flange 117 of the tubeaxial fan 100. The outer and inner flanges 228 and 230 are flat and parallel to each other. Between the two flanges 228 and 230, there is a rounded wall 232 which facilitates movement of the air into the first upstream end of the tubeaxial fan 100 and reduces turbulence going across the propeller 160 and the vane 130.

The embodiment shown in FIG. 12 includes various brackets 234 for mounting the fan 100 to a floor, other equipment, etc.

The invention described above, with various combinations of the curved-edge support vane 130, the increased distance between the propeller 160 and the support vane 130, the reduced number of blades 162, and the curved inlet bell 210, results in significantly reduced fan noise. This reduced fan noise during operation of the fan results in a safer environment for those working near the fan.

More particularly, as can be seen from the following table of test results, using the same fan diameter, flow and fan speed for the conventional fan 10 and the fan 100 of the present invention, the fan 100 of the present invention exhibits lower noise as measured by sones. More particularly, the reduction in sones is about 22% using the present invention, when compared with a conventional tubeaxial fan of equal diameter. Thus, the structure of the fan 100 leads to a quieter overall fan, which reduces noise levels for workers that must work in an environment that uses a tubeaxial fan. In addition, the cost or a tubeaxial fan according to the present invention is expected to be comparable to a conventional tubeaxial fan.

| Fan | Diameter (in.) | Flow (cfm) | SP (in. w.g.) | Speed (rpm) | LwA (dB) | Sones |
|---|---|---|---|---|---|---|
| Conventional | 34 | 13000 | 0.375 | 1003 | 95.4 | 40.9 |
| Invention | 34 | 13000 | 0.375 | 1004 | 91.1 | 31.7 |

The foregoing is considered illustrative only of the principles of the invention. Further, since numerous modifications and changes will readily occur to those skilled in the art, it is not desired to limit the invention to the exact construction and operation shown and described. For example, while the preferred embodiment described above applies mostly to tubeaxial fans, the principles of the present invention can be applied to other types of propellers and/or propeller housings requiring performance like that of tubeaxial fans, including flow properties, pressure differentials, output efficiencies, vibration and noise levels. Accordingly, all suitable modifications and equivalents may be resorted to that fall within the scope of the invention and the appended claims.

What is claimed is:

1. A fan, comprising:

a housing having an axis, an air inlet and an air outlet, wherein air flow is in a direction through the fan from the air inlet to the air outlet;

a planar supporting plate, the plane of which is parallel to the axis, connected to an interior of the housing and positioned between a motor and the air inlet;

a shaft at the axis and being supported by the planar supporting plate; and a propeller attached to the shaft and being positioned near the air outlet of the housing, wherein the planar supporting plate includes an edge with a first portion facing the propeller and being spaced from the propeller a first distance, and with a second portion with at least one curved surface facing the propeller and being spaced from the propeller a second, larger distance.

2. The fan as recited in claim 1, wherein a shortest distance from the propeller to the at least one curved surface is one chord length at an outer tip of a blade of the propeller.

3. The fan as recited in claim 2, wherein the shortest distance is about 8 inches.

4. The fan as recited in claim 1, wherein the first portion includes a straight portion closest to the propeller and two straight side portions extending perpendicularly from the straight portion away from the propeller, and wherein the at least one curved surface is a first curved surface extending from one of the two straight side portions and is a second curved surface extending from the other of the two straight side portions.

5. The fan as recited in claim 4, wherein each of the first and second curved surfaces is "S" shaped.

6. The fan as recited in claim 1, wherein the at least one curved surface is a sine wave and a period of the sine wave is $1/5^{th}$ of a diameter of the propeller.

7. The fan as recited in claim 1, wherein the planar supporting plate includes first and second sides that are connected to opposing interior sides of the housing at about a midpoint between the air inlet and the air outlet of the housing.

8. The fan as recited in claim 1, wherein the propeller has only five blades.

9. The fan as recited in claim 1, further comprising an inlet bell attached to the inlet of the housing, wherein the inlet bell has a curved surface that narrows in a direction toward the air inlet of the housing.

10. A tubeaxial fan, comprising:

a cylindrical housing having a first length along a longitudinal axis, an air inlet, an air outlet and opposing first and second interior sides, wherein air flow is in a direction through the fan from the air inlet to the air outlet;

a planar supporting plate, the plane of which is parallel to the axis, having first and second sides connected to the first and second interior sides of the housing, respectively, and positioned between a motor and the air inlet, with the entire planar supporting plate being spaced from the motor;

a propeller shaft at the axis and being connected to the planar supporting plate; and a propeller attached to the propeller shaft near the air outlet of the housing, wherein the planar supporting plate includes an edge with a first portion facing the propeller and being spaced from the propeller a first distance, and with a second portion with at least one curved surface facing the propeller and being spaced from the propeller a second, larger distance.

11. The tubeaxial fan as recited in claim 10, wherein a shortest distance from the propeller to the at least one curved surface is one chord length of a blade of the propeller.

12. The tubeaxial fan as recited in claim 10, wherein the at least one curved surface is an "S" shape.

13. The tubeaxial fan as recited in claim 12, wherein the "S" shape is defined by a sine wave and a period of the sine wave is $1/5^{th}$ of a diameter of the propeller.

14. The tubeaxial fan as recited in claim 10, wherein the first and second sides of the planar supporting plate are connected to the first and second interior sides of the cylindrical housing about halfway along the first length.

15. The tubeaxial fan as recited in claim 10, wherein the propeller has a hub from which extend only five blades.

16. The tubeaxial fan as recited in claim 10, further comprising an inlet bell attached to the inlet of the cylindrical housing, wherein the inlet bell has a curved surface that narrows in a direction toward the air inlet of the cylindrical housing.

17. A tubeaxial fan, comprising:

a cylindrical housing having a first length along a longitudinal axis, an air inlet, an air outlet and opposing first and second interior sides, wherein air flow is in a direction through the fan from the air inlet to the air outlet;

a planar supporting plate, the plane of which is parallel to the axis, having opposing first and second sides connected to the opposing first and second interior sides of the cylindrical housing, respectively, and positioned between a motor and the air inlet, with the entire planar supporting plate being spaced from the motor;

a shaft extending along the axis and being connected to the planar, supporting plate; and a propeller having a diameter, being attached to the shaft and being positioned near the air outlet of the cylindrical housing, wherein the planar supporting plate includes an edge with a first portion facing the propeller and being spaced from the propeller a first distance, and with a second portion with two curved portions facing the propeller and being spaced from the propeller a second, larger distance, and wherein a shortest distance from the propeller to either of the two curved portions is one chord length of a tip of a blade of the propeller.

18. The tubeaxial fan as recited in claim 17, wherein each of the two curved portions is a sine wave and a period of the sine wave is $1/5^{th}$ of a diameter of the propeller.

19. The tubeaxial fan as recited in claim 17, wherein the first and second sides of the planar supporting plate are connected to the cylindrical housing about halfway along the first length.

20. The tubeaxial fan as recited in claim 17, wherein a number of blades of the propeller is five.

21. A fan, comprising:

a housing having an inlet and an outlet;

a planar supporting plate connected to an interior of the housing;

a shaft supported by the planar supporting plate; and a propeller attached to the shaft and being positioned near the outlet of the housing, wherein the planar supporting plate includes at least one curved surface facing the propeller, and wherein the at least one curved surface is a sine wave and a period of the sine wave is $1/5^{th}$ of a diameter of the propeller.

22. A tubeaxial fan, comprising:

a cylindrical housing having a first length along a longitudinal axis, an inlet, an outlet and opposing first and second interior sides;

a planar supporting plate having first and second sides connected to the first and second interior sides of the housing, respectively;

a propeller shaft connected to the planar supporting plate; and a propeller attached to the propeller shaft near the outlet of the housing, wherein the planar supporting plate includes first and second lateral curved edges facing the propeller, wherein each of the curved edges is an "S" shape, and wherein the "S" shape is defined by a sine wave and a period of the sine wave is $1/5^{th}$ of a diameter of the propeller.

23. A tubeaxial fan, comprising:

a cylindrical housing having a first length along a longitudinal axis, an inlet, an outlet and opposing first and second interior sides;

a planar supporting plate having opposing first and second sides connected to the opposing first and second interior sides of the cylindrical housing, respectively;

a shaft connected to the planar supporting plate; and a propeller having a diameter, being attached to the shaft and being positioned near the outlet of the cylindrical housing, wherein the planar supporting plate includes two curved edges facing the propeller, wherein a shortest distance from the propeller to either curved edge is one chord length of a tip of a blade of the propeller, and wherein each of the curved edges is a sine wave and a period of the sine wave is $1/5^{th}$ of a diameter of the propeller.

* * * * *